US005124102A

United States Patent [19]

Serafini

[11] Patent Number: 5,124,102

[45] Date of Patent: Jun. 23, 1992

[54] FABRIC USEFUL AS A CONCRETE FORM LINER

[75] Inventor: Franco L. Serafini, Leudelange, Luxembourg

[73] Assignee: E. I. du Pont de Nemours and Company, Wilmington, Del.

[21] Appl. No.: 625,721

[22] Filed: Dec. 11, 1990

[51] Int. Cl.[5] ..... B28B 1/26; B28B 7/36

[52] U.S. Cl. ..... 264/86; 249/113; 249/134; 249/135; 249/141; 249/189; 264/219; 425/84

[58] Field of Search ..... 249/113, 134, 135, 141, 249/189; 264/86, 87, 219; 425/84, 85; 29/448, 449; 428/212, 280, 286, 290, 302, 311.5, 315.5

[56] References Cited

U.S. PATENT DOCUMENTS

| | | | |
|---|---|---|---|
| 2,310,391 | 2/1943 | Brooks et al. | 249/114.1 |
| 2,628,402 | 2/1953 | Billner | 425/113 |
| 2,671,940 | 3/1954 | Billner | 425/85 |
| 2,688,175 | 9/1954 | Billner | 425/85 |
| 3,477,103 | 11/1969 | Troth, Jr. | 19/163 |
| 3,600,771 | 8/1971 | Dyrander | 425/85 |
| 3,726,950 | 4/1973 | Turzillo | 264/32 |
| 3,780,975 | 12/1973 | Turzillo | 249/1 |
| 3,821,062 | 6/1974 | Henderson | 428/113 |
| 3,991,244 | 11/1976 | Debbas | 428/113 |
| 4,162,190 | 7/1979 | Ashworth | 428/280 |
| 4,213,926 | 7/1980 | Toyoda et al. | 264/74 |
| 4,335,065 | 6/1982 | Ando | 264/87 |
| 4,439,273 | 3/1984 | Curry | 428/280 |
| 4,500,588 | 2/1985 | Lundström | 428/280 |
| 4,657,806 | 4/1987 | Dutt | 428/280 |
| 4,730,805 | 3/1988 | Yokota et al. | 249/113 |
| 4,761,326 | 8/1988 | Barnes et al. | 428/311.5 |
| 4,787,597 | 11/1988 | Yokota et al. | 249/113 |
| 4,851,281 | 7/1989 | Wood | 428/280 |
| 4,856,754 | 8/1989 | Yokota et al. | 249/113 |
| 4,863,792 | 9/1989 | Mrozinski | 428/315.5 |
| 4,877,679 | 10/1989 | Leatherman et al. | 428/280 |
| 4,882,217 | 11/1989 | FitzPatrick | 428/280 |

FOREIGN PATENT DOCUMENTS

| | | | |
|---|---|---|---|
| 53441 | 5/1912 | Austria | 249/113 |
| 2158767 | 11/1985 | United Kingdom . | |

OTHER PUBLICATIONS

Typar ® Report 6, *Dam Construction on the River Euphrates,* A Smooth Improvement (Nov. 88).

IABSE Symposium Report, "Improvement of Surface Quality of Concrete Structures by Unique Framework", Tanaka et al. (Sep. 87).

Nikkei New Materials, No. 32, pp. 117–120, Aug. 1987 (partial translation 3rd row, line 9, p. 117 to 1st row, line, 9, p. 118).

DuPont Zemdrain Bulletin (1990)–For High-Quality Concrete Surfaces.

Co-pending U.S. Pat. Application Ser. No. 07/472,902 filed Jan. 31, 1990.

*Primary Examiner*—Jay H. Woo
*Assistant Examiner*—Khanh P. Nguyen

[57] ABSTRACT

Concrete forms utilizing a concrete form liner including a two-sided fabric having a different range of pore sizes on one side compared to the opposite side. In one embodiment, a microporous coating, such as an ethylene-vinyl chloride microfoam dispersion, is placed on one side of a porous fabric to controllably reduce the pore size of the fabric on that side to between 0.2 to 20 microns. The coated fabric is used in combination with a support and a grid to form a concrete casting system wherein the coated side of the fabric is placed directly in contact with the concrete. The microporous coating stabilizes the surface fibers of the fabric thereby reducing the tendency of the fibers to stick to the concrete. The pore size of the coated side of the fabric must be small enough to substantially keep all concrete particles from passing through the fabric, but sufficiently open to permit the passage of water and air.

22 Claims, 2 Drawing Sheets

FABRIC USEFUL AS A CONCRETE FORM LINER

FIELD OF THE INVENTION

The present invention relates to an improved concrete form liner and to forms for concrete manufacture which yield patterned or very smooth concrete surfaces. More particularly, the invention relates to concrete forms utilizing an improved concrete form liner comprising a two-sided fabric having a different range of pore sizes on one side compared to the opposite side.

BACKGROUND OF THE INVENTION

In the manufacture of concrete, the concrete is usually cast using a concrete form which takes the shape of the form. The wet concrete is poured into or against the concrete form and, upon setting and removal of the form, the newly-exposed concrete surface is a reverse impression of the inner surface of the form. In the case of wooden forms, the concrete takes the appearance of the wood grain; and in the case of forms involving seamed form members, the concrete shows any seams which have not been sufficiently masked.

Air is often added to a concrete mix and water is often added in excess of the amount required for hydration. Such air and water are useful to render the mix flowable and to facilitate handling and pouring. However, the excess water, if left undrained, results in concrete having a weakened surface and, the air, if not removed, results in surface pores as large as 0.1 to 3 cm, which pores leave an uneven surface open to the effects of dirt and erosion by the freeze-thaw cycles of water.

Examples of prior art concrete forms include:

U.S Pat. No. 4,730,805 (Yokota et al.) which discloses a form for forming concrete which utilizes a support and at least two layers of fabric over the support. The support can have lugs to space the fabric from the support and the fabric layers and the lugs assist in draining water away from the curing concrete. The support may have drainage holes for removal of excess water and air. The fabric is bonded to the support and is stiff and immovable relative to the support.

U.S. Pat. No. 4,856,754 (Yokota et al.) which discloses a concrete form using double-woven fabrics on a support plate with holes to provide water drainage. One woven fabric is adhered to the plate and the other woven fabric is sewn to the first.

U.S. patent application Ser. No. 07/472,902 filed Jan. 31, 1990, now abandoned which discloses a form for patterned concrete comprising a support means, a grid having interconnected spacing members which form holes in the grid having an individual area of at least 0.25 $cm^2$ and at least a portion of which rests against the support means, and a porous fabric juxtaposed with the grid and set apart from the support by the grid. The fabric generally has a pore size of between 10 to 250 microns on each side so that a number of fine concrete particles (typically 30 to 90 microns) can enter and fill the fabric's open spaces and so that excess water and air can pass therethrough.

Fine concrete particles typically fill the fabric's larger pores, especially if excessive concrete compaction occurs. Usually, if enough fine concrete particles have entered the fabric structure and sufficient concrete curing is allowed, then the separation of the fabric from the cured concrete becomes very difficult or even impossible. This occurs because the concrete particles that have entered the fabric and hardened therein pull the fabric fibers out of the surface of the fabric when the fabric is separated from the concrete. The problem becomes worse when the fabric is reused with loose surface fibers since the loose fibers tend to become embedded in the cured concrete thereby causing delamination of the fabric web. The problem is heightened if the fabric is not handled with care during form assembly and disassembly, since mechanical friction (e.g., rubbing) tends to make the fabric fuzzy and causes the loose fibers to stick to the concrete. Multiple use of the fabric forms causes more of the fabric pores to become plugged by fine concrete particles resulting in greatly reduced levels of water and air evacuation.

Clearly, what is needed is an improved concrete form and concrete form liner which are both sufficiently reusable and which do not have the deficiencies inherent in the prior art. Specifically, the improved form should have a fabric liner which does not easily stick to the concrete surface and which prevents substantially all concrete particles from passing through the liner, yet which is sufficiently open to permit the passage of excess water and air. Other objects and advantages of the present invention will become apparent to those skilled in the art upon reference to the attached drawings and to the detailed description of the invention which hereinafter follows.

SUMMARY OF THE INVENTION

In accordance with the invention, there is provided an improved concrete form having a porous form liner. The liner comprises a two-sided fabric having a different range of pore sizes on one side (i.e., first side) compared to the opposite side (i.e., second side). The first side of the fabric has a pore size in the range of between 0.2 to 20 microns, preferably 0.5 to 10 microns, while the second side of the fabric has a pore size that is larger than the pore size of the first side and in the range of between 10 to 250 microns, preferably 30 to 150 microns. The critical pore size of the first side allows the fabric to keep substantially all concrete particles from entering therein while still allowing excess water and air to escape from the surface of the concrete. The larger pores on the second side of the fabric increase the draining effect both within the plane of the fabric and between the fabric plane and the form. In addition to the reduced pore size, the surface fibers on the first side of the fabric are stabilized such that when the first side is placed in direct contact with the concrete, the fabric resists sticking to the concrete. The individual stabilized fibers of the fabric resist friction and avoid being loosened to the point where they become embedded in the concrete.

In one aspect, the invention provides for an improved concrete form for making patterned concrete comprising:

(a) a support means;

(b) a grid having interconnected spacing members which form holes in the grid having an individual area of at least 0.25 $cm^2$, and at least a portion of the spacing members rest against the support means; and (c) a porous, two-sided fabric juxtaposed with the grid and set apart from the support by the grid, the improvement comprising the two-sided fabric having a first side having a pore size between 0.2 and 20 microns to prevent substantially all concrete particles from entering therein and a second side having a pore size larger than the pore size of the first side and between 10 and 250 microns to increase the draining effect of the fabric on any excess water present.

In a preferred embodiment, the fabric comprises a 70 to 600 g/m$^2$ woven or nonwoven sheet material that has been stabilized by being coated on a first side with 5 to 80 g/m$^2$ of a microfoam dispersion, preferably ethylene-vinyl chloride, ethylene-vinyl acetate or a copolymer thereof, to produce a pore size on the first side of the fabric of between 0.2 to 20 microns, preferably 0.5 to 10 microns. Additionally, the coating can be smooth calendered in order to achieve higher surface stability and an appropriate lubricant, preferably silicon or natural oil, can be applied to the coating to further prevent the coated side of the fabric from sticking to the concrete.

In a particularly preferred embodiment, the fabric comprises a first side and a second side wherein the first side is made up of lower denier fibers than the fibers that make up the second side. Typically, a thin, stabilized layer of the lower denier fibers (about 1/5 of the total fabric fibers) make up the first side of the fabric. Surface stabilization is achieved by reducing fiber draw in order to decrease the tenacity of the lower denier fibers. Therefore, when the first side of the fabric is smooth calendered, the surface fibers will squeeze together and smooth out across the fabric surface. The result is a porous, two-sided fabric with a first side that has a very smooth surface (just as if it had been stabilized by being coated) and a controllable pore size between 0.2 to 20 microns.

There is, also, provided a process for making the improved form by establishing a support with the shape desired for a concrete article to be made, affixing a grid to the support wherein the grid has interconnected spacing members at least a portion of which rest against the support, and juxtaposing a porous, two-sided fabric, having a first side having a pore size of between 0.2 and 20 microns and a second side having a pore size larger than the pore size of the first side and between 10 to 250 microns, with the grid, the fabric set apart from the support by the grid. The process may further comprise stretching the porous, two-sided fabric uniformly over the grid at a tension of from 0.2 to 3.0 kg/lineal cm in order to make concrete having a smooth surface. The second side of the fabric is placed towards the grid. The process of this invention also includes establishing a support means with holes and juxtaposing the porous, two-sided fabric with the support means.

As used herein, the "first side of the fabric" means the side of the fabric that is placed in direct contact with the wet concrete during casting.

As used herein, the "second side of the fabric" means the side of the fabric which is placed in contact with the grid or support of the concrete form.

BRIEF DESCRIPTION OF THE DRAWINGS

The invention will be better understood with reference to the following figures.

DETAILED DESCRIPTION OF THE PREFERRED EMBODIMENTS

Figure 1:
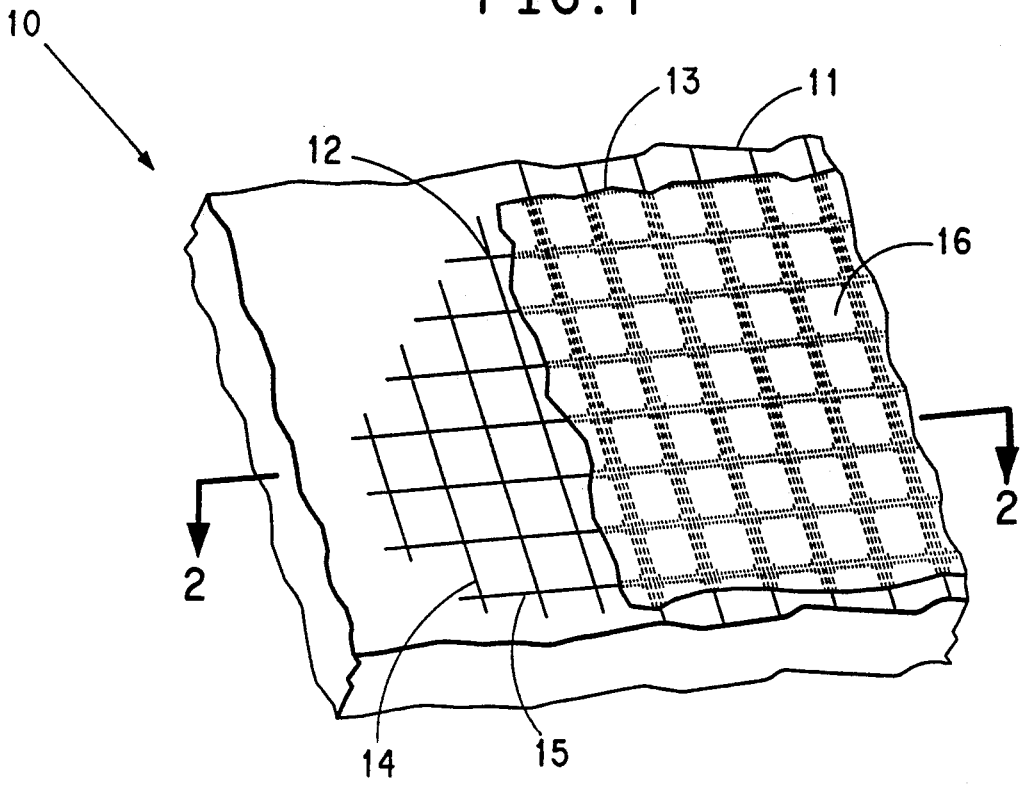
FIG. 1 is a representation of a concrete form, in partial section, with a grid and the improved fabric of the invention.

Referring now to the figures, wherein like reference numerals represent like elements, FIG. 1 shows a concrete form 10 including support 11 which can be of any material which has been traditionally used as a material for concrete forms. Support 11 must have enough strength to support the weight of the wet concrete before curing. The support can be made of wood or it can be of metal or plastic; and, while it should be relatively smooth and flat, for use in making concrete with a patterned surface, the smoothness is not critical.

Grid 12 can be of any noncompressible material such as wire screening or plastic netting. The grid can have holes of any regular or irregular shape defined by interconnecting spacing members 14 and 15. Any shape (e.g., round, square, triangular, or irregular) can be used; and it is preferable that the area of the holes should be greater than about 0.25 cm$^2$ and less than about 2500 cm$^2$. Different size holes can be used in a given application for any desired purpose. The area of the holes can be large enough that there is opportunity for porous fabric 13 to be pressed through the holes by wet concrete to contact support 11, or the holes can be so small (i.e., less than about 0.25 cm$^2$) and fabric 13 can be drawn so taut that the fabric is not deformed enough by compaction pressure of the concrete mix to reach the surface of the support 11. The grid 12 should have a thickness of from about 0.2 to 50 mm. The limits of the thickness are a matter of convenience and practicality and are thus not critical to the invention. Typically, the thickness should be great enough to permit the flow of water and air from the body of wet concrete, yet not so thick that there is excess distance between the support 11 and the fabric 13 juxtaposed with the grid 12. Grid 12 can be made in such a way that interconnecting spacing members 14 and 15, either lie in the same plane, or lie on top of one another by being woven or nonwoven. It is preferred that the grid be composed of interconnected spacing members 14 and 15 in which crossing elements are woven such that the crossing elements lie atop one another at the points of intersection.

Fabric 13 can be woven or nonwoven and can be made from natural or synthetic materials. The preferred material is a thermobonded polyolefin sheet material, such as polyethylene or polypropylene, having a basis weight of from about 70 to 600 g/m$^2$. However, other polymers can be used as a fabric material, such as PVC, polyester or any other polymer with sufficient chemical resistance when used in the basic environment of the fluid concrete. The fabric is treated or made in such a way that one side (i.e, the first side) has a pore size of between 0.2 to 20 microns, preferably 0.5 to 10 microns and the opposite side (i.e., the second side) of the fabric has a pore size larger than the pore size of the first side and between 10 to 250 microns, preferably 30 to 150 microns. The range of pore sizes on each side of the fabric permits the passage of water and air, but prevents the passage of substantially all solid concrete particles in the mix. The fabric can be of any convenient thickness, but it must be adequate to withstand the high compaction pressures brought against it by the wet concrete. It is preferred that the porous fabric should be at least 0.5 mm thick. In addition, the second side of the fabric can have a pattern of protrusions or depressions of between 0.1 to 2 mm in depth in order to promote water wicking during concrete hardening.

One specific method of treating the fabric to obtain the proper pore size on the first side of the fabric is to uniformly coat the first side with a polymer material, preferably a microfoam dispersion of the polymer. The coated, porous fabric allows water and air, present close to the surface of the concrete, to be evacuated while fine cement particles of about 4 microns or larger are retained. The coating also stabilizes the surface fibers of the fabric so that they will resist friction and will not become embedded in the concrete. As a result, the concrete formed is better in quality (no cement loss), the separation of the form liner from the concrete is easier (there are no fibers sticking to the concrete surface), form handling is less critical and, depending on the concrete type, the form liner can be used 4–6 times as compared to 1–2 times for the untreated prior art version disclosed in U.S. patent application Ser. No. 07/472,902. In particular, the surface of the concrete is more compact, there are no blowholes or pores present, and the concrete is less permeable to water or gases (i.e., slower carbonation), thereby increasing the life of the concrete especially when used in harsh environments.

The fabric coating can be smooth calendered so as to achieve higher surface stability, and an appropriate release oil (silicon, natural oil or any suitable lubricant product used in the concrete industry) can be added to further aid in preventing the coating from sticking to the concrete.

It should be noted that dispersion foam coatings are not critical, and laminates (dot, swirl or pattern lamination) of a suitable porous fabric with a thin microporous film or microperforated film are also suitable for purposes of the invention. For example, the fabric may comprise a non-compressible base material (e.g., metal or plastic) laminated to a microporous film such that the film makes up the first side of the fabric. Moreover, the fabric may comprise a spunbonded sheet material that has been smooth calendered to stabilize the fibers of the first side of the fabric. As long as the following key properties defining the improved fabric's functionality exist, the type of coating or method of treatment are not critical to the invention. These properties include:

(a) having sufficient micropores of a size between 0.2 to 20 microns on one side of the fabric (Larger pores of greater than 20 microns may work, but will provide worse results since concrete particles will enter the fabric structure and cause the form liner to stick to the concrete. Smaller pores of less than 0.2 microns will not allow sufficient air and water to pass therethrough.);

(b) having an air permeability of between 0.05–4 $m^3/m^2/min$ at a pressure of 1 cm of water (ASTM test method D 737 measured on a 10 $cm^2$ area);

(c) having a water tightness of between 1–40 cm (water head required to get the first 3 drops of water through the fabric); and (d) having a total fabric thickness of at least 0.3 mm (ASTM test method D 1777 at a pressure of 0.05 bars)

Figure 2:
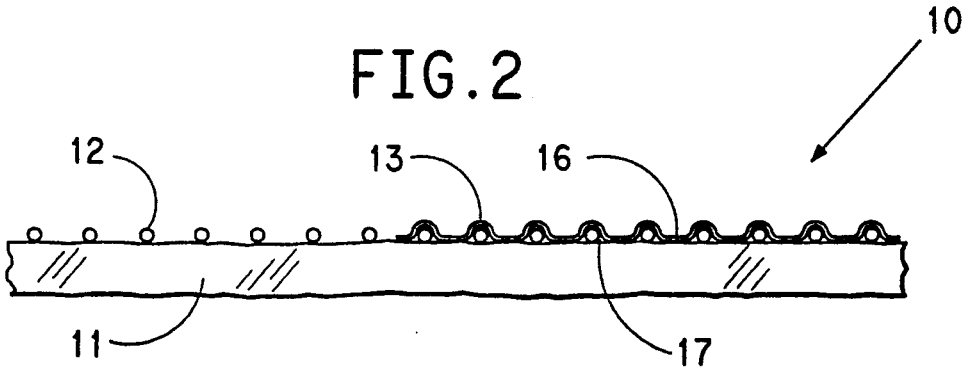
FIG. 2 is a cross-sectional view of the form from FIG. 1.

Referring now to FIG. 2, concrete form 10 is made by affixing grid 12 against support 11 which has been established to have the shape desired in a final concrete article, and then juxtaposing fabric 13 with the grid. The grid 12 need not be closely affixed to support 11 but it must be affixed to the degree required to assure that it will remain in place during use of the form. Likewise, fabric 13 should not be closely affixed to grid 12, but merely juxtaposed therewith. For forms wherein the intended concrete article has a patterned surface, the fabric 13 can be effectively juxtaposed by use of staples or small nails placed periodically at relatively large distances at the edge or backside of the form. It has been determined that the fabric should not be closely attached to the grid. As used herein, the word "juxtaposed" means that the fabric 13 should be placed against grid 12; but that the surface of one should not be bound to the surface of the other.

It has been discovered that smooth and patterned concrete surfaces can be made without finishing operations. Moreover, it has been discovered that such smooth and patterned surfaces have qualities which are improved over concrete surfaces of the prior art. The invention results in concrete having a surface with patterns constituted by convexities or raised areas. This is done by juxtaposing fabric 13 with grid 12, both against support 11; and, as concrete is poured into the form, the concrete presses fabric 13 into the holes in grid 12 and against support 11, causing depressions 16 along with channels 17. As a result of pressing into the fabric 13 to make depressions 16, the concrete will form one convexity for each depression 16. When the grid is made in such a way that the depressions form a pattern of any kind, whether regular or irregular, the concrete will form a mating pattern of convexities. Water and air will pass through fabric 13, into channels 17, and away from the concrete.

Figure 3:
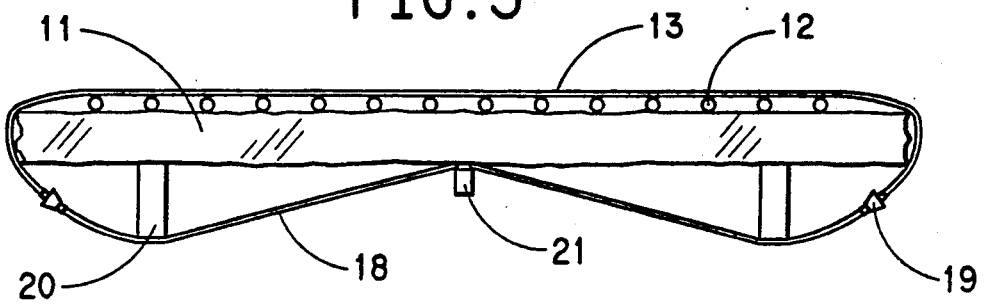
FIG. 3 is a cross-sectional view of a form having the improved fabric under uniform tension over the grid.

As one particular embodiment, and looking to FIG. 3 for detail, when fabric 13 is held with continuous, uniform force, such that it is stretched uniformly over grid 12, a completely smooth concrete surface can be made. Making a completely smooth concrete surface is difficult due to the difficulty in holding fabric 13 without wrinkles during the concrete pouring process. This is because support 11 and fabric 13 may shrink or expand due to changes in temperature or humidity. It has been determined that as little as ½% of shrinkage or expansion in either the support or the fabric is enough to cause wrinkles in the fabric and consequent irregularities in the concrete surface. It should be pointed out that, in the case where patterned concrete surfaces are being made by this invention, the effects of shrinkage and expansion are taken up in the depressions. However, when completely smooth concrete surfaces are desired, the grid holes must be so small that no depressions form. That is, for completely smooth concrete surfaces, the grid should have interconnected spacing members forming holes less than 0.25 $cm^2$. Continuous, uniform force is applied to fabric 13 by connecting elastic or resilient members 18 to edges of fabric 13 by means of grippers 19. Preferably, members 18 are springs or are made from rubber or some other elastomer. Members 18 are brought over risers 20 and attached to anchor 21. Of course, any arrangement of members 18 is acceptable which results in tension being applied to fabric 13. A multitude of members 18 can be attached to fabric 13, thereby assuring continuous, uniform, tension over the expanse of fabric. It has been determined that a tension of 0.2 to 3.0 kg/lineal cm is adequate for the practice of this invention. It should be understood that the tension can be applied in any manner which is effective to yield the proper result.

When a completely smooth and flat support 11 is used, there is no need for any grid in the making of concrete with a completely smooth surface, so long as fabric 13 is stretched over the support at a uniform tension, as described above. Moreover, when the fabric 13 is fixed on a flat, smooth support without any grid, but with sufficient tension applied in both directions, the resulting concrete is absolutely flat, free of fold marks and of very high quality.

Figure 4:
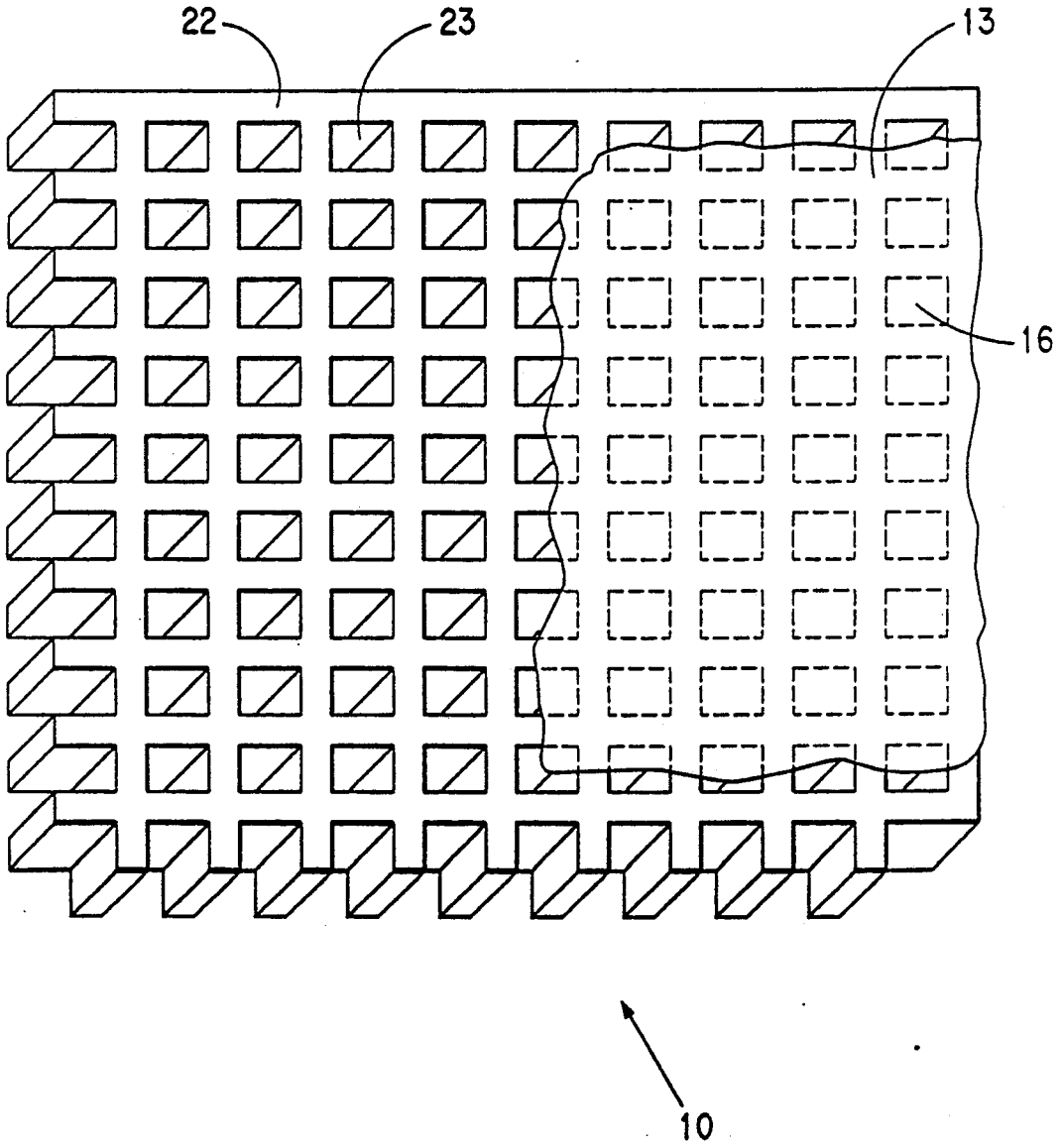
FIG. 4 is a representation of another form, in partial section, with support means having holes and the improved fabric of the invention.

Referring to FIG. 4, concrete form 10 includes support means 22 with holes 23. Support means 22 can be of any material for concrete forms, however, it must have enough strength to support the weight of the wet concrete before curing. The support means can be of wood or it can be of metal or plastic. The holes in support means 22 must be deep enough to permit drainage of air and water from the concrete mix and preferably extend through the thickness of the support means. The holes can be of any regular or irregular shape or size, and should be greater than about 0.25 $cm^2$ and less than about 2500 $cm^2$. In this embodiment, fabric 13 can be juxtaposed with support means 22 and the concrete mix will cause depression 16 in the same way that the depressions are formed using the form of FIG. 1 with a separate grid.

The improved form liner exhibits many advantages over the prior art. The fabric has much more fuzz resistance since the surface fibers are held in place by the fabric stabilization (e.g., coating). There are much fewer concrete particles (only very fine particles) that will pass through the coating or the stabilized first side. The liner will remain useable until larger concrete particles plug up each given pore and build up a filter cake. The concrete particles that pass through the first side of the fabric will tend to be washed back out and away with the excess water. When a coating is used, there will be very few concrete particles that get behind the coating, therefore less adhesion to the concrete can be expected. All this means that the improved liner is reusable several times. As an added benefit, the form can be dismantled sooner after pouring the concrete than forms of the prior art.

EXAMPLES

The stabilization techniques will be further described by reference to the following non-limiting examples. All percentages are by weight unless otherwise indicated.

EXAMPLE 1

A heat polymerizable water emulsion was made by mixing ethylene-vinyl chloride (33% solids) with 2–3% Latekoll (commercially available from Wacker Chemie of Burghausen, Germany and added for improved adhesion) and 10% of a foam stabilizer (ff Plex 6112 S commercially available from Wacker Chemie). A foam was generated with the emulsion by using an air mixer (commercially available from Werner Mathis Minimix as Type 4484) to obtain a uniform stable foam with a density of about 280 g/liter. The foam obtained was applied to a 290 $g/m^2$ nonwoven sheet of Typar® (a thermobonded polypropylene sheet material commercially available from Du Pont de Nemours, S.A., Luxembourg) using a variopress coater (commercially available from Johannes Zimmer of Klagenfurt, Germany) at a speed of 10 m/min. Typar® sheets are prepared using the process disclosed in U.S. Pat. No. 3,477,103 (Troth, Jr.), the contents of which are incorporated herein.

Different coater settings were tested in order to obtain different levels of coating weights and fabric penetration. The coated fabric was passed into a drying oven (commercially available from Brueckner of Siegsdorf, Germany) running at 100 degrees C. at the entrance and 140 degrees C. at the exit so as to evaporate the water and to polymerize the ethylene-vinyl chloride foam. The foam coated samples having between a 10–40 $g/m^2$ coating, exhibited air permeability values of between 0.1–0.3 $m^3/m^2/min$ and a water tightness of between 8–20 cm water head. Thus, the pore size of the coated side of the fabric can be controlled by adjusting the coater settings.

Samples of the coated fabric were fixed to a wooden form using staples, and 8 cm thick × 30 cm wide × 50 cm high concrete slabs were made by placing the coated side of the fabric against the concrete (grade C 45 with a slump of about 6 cm). Concrete compaction was done manually by dropping the form 15 times from a height of 15 cm with the concrete inside in order to avoid mechanically damaging the fabric coating by commonly-used concrete vibrators.

For a control, slabs of the same dimensions were made under the same conditions, but using untreated (i.e., uncoated) Typar® sheet material or standard wooden forms against the concrete. Concrete obtained with a standard wooden form exhibited a multitude of blowholes of different sizes (0.5–12 mm) and depths all over the surface. Concrete bleeding also took place in different areas. (Concrete bleeding is a well known phenomenon to those in the construction art and involves excess water washing out concrete near the form surface. Bleeding happens when the concrete shrinks leaving some space between the hardening concrete and the form. This leaves a clearly visible area on the concrete surface that looks like it has washed out.) On the other hand, concrete obtained using coated or uncoated Typar® sheet material exhibited no blowholes, no cement bleeding at all, and showed a darker, harder surface (30–50% higher hardness as measured by a Schmidt-Hammer tester) than the concrete obtained with the standard wooden form.

Removal of the uncoated Typar® sheet material from the concrete required some force (15–20 kg) and a number of sheet fibers remained entangled in the concrete. After one use, the sheet surface fibers were so loosened that a second use would have made sheet removal impossible due to full fabric delamination. Conversely, removal of the foam coated Typar® sheet material was much easier, but still, some force was required as a thin layer of the coating stuck to the concrete causing delamination of the foam. No fibers at all stuck to the concrete, such that a second, third and fourth use were able to be made before too many surface fibers started sticking to the concrete.

EXAMPLE 2

In this example, 1–2 $g/m^2$ of silicon oil was applied on the coated side of the same foam coated Typar® as described in Example 1 above. Concrete slabs were made as provided above. After the concrete slabs were made, removal of the coated fabric from the cured concrete surface was extremely easy. No foam delamination was observed and the quality of the concrete surface was excellent.

EXAMPLE 3

In this example, the same foam coated sample as described in Example 1 was smooth calendered at 150 degrees C. under a pressure of 50 kg/cm width and at a speed of 10 m/min. The sample exhibited much improved surface stability as compared to the non-calendered foam coated sample, and when tested as described in Example 2, it provided very similar results. The advantage of this sample is that it makes fixation and handling much less critical during form assembly and disassembly than with the non-calendered fabric samples.

EXAMPLE 4

In this example, a sample of microporous Tyvek® 1025 D (a spunbonded polyethylene sheet material commercially available from E. I. du Pont de Nemours and Company, Wilmington Del.) was stapled to the top of a Typar® fabric sheet on the first side (i.e., concrete side) and concrete slabs were made as provided in Example 1, except that a standard concrete vibrator was used (Tyvek® needs over 100 cm water head in order to let some water through, so more intense vibration was required to evacuate the excess water). The concrete obtained using this sample exhibited no blowholes at all and had a very dark color, although the effect was limited in depth (1–2 mm near the concrete surface versus 4–7 mm on the samples obtained with uncoated Typar® alone or with foam coated Typar® ). This indicates that water evacuation stopped for this sample when the concrete vibrator was turned off, while for Typar®, water tends to evacuate for about 2 hours after vibration. Removal of the fabric from the cured concrete required little force during the first two uses, but was very difficult to remove on the third use since the Tyvek® sheet stuck to the concrete and delaminated.

EXAMPLE 5

In this example, a sample of a nonwoven Typar® sheet material was extrusion coated with 20 g/m$^2$ of polyethylene on one side. The resulting water impermeable side of the sheet was then perforated by means of needling so as to obtain about 25 perforations per cm$^2$, each perforation having a diameter of about 0.3 mm. The sample exhibited an air permeability and a water tightness within the above-mentioned range for fabric functionality. The coated side was used to cast concrete on, and the results were comparable to Example 2, with the exception of a slightly darker color.

EXAMPLE 6

In this example, polypropylene melt blown fibers were spun onto a sample of Typar® sheet material and pattern-bonded to the sheet surface in order to obtain sufficient adhesion. Concrete was cast on the melt blown side. The cured concrete produced quite unexpected results as only a very thin layer of the melt blown fibers stuck to the concrete. This produced the effect of the concrete having been painted. The surface of the concrete was very hard and exhibited no blowholes. The concrete had surface hardness values comparable to the ones obtained with Typar® sheet material alone and values 30–50% higher than the ones obtained with a standard impermeable concrete form.

EXAMPLE 7

In this example, a special sample of Typar® sheet material was prepared by making the following changes to the basic process collectively disclosed in U.S. Pat. Nos. 3,477,103 (Troth, Jr.); 3,821,062 (Henderson); and 3,991,224 (Debbas), the contents of which are incorporated herein. The fiber denier of a cross-directional (cross oriented) block of filaments was reduced from 10 to 7 den, by reducing the throughput of that block, while maintaining the filament speed. The filament draw of the same block was reduced from 1.85 to 1.55, to produce a filament tenacity of 2.2 g/den vs. 3.5 g/den. The nip pressure was increased from 80 to 125 dN/cm on the smooth calender nip of the pattern bonder. As a result, a thin layer (about 1/5 of the total fibers) of the filaments made up a very smooth first side of the Typar® sheet.

On the side with the finer denier filaments, the sample looked and felt like it had been coated, so the fibers had no tendency to come loose (i.e., no fuzz tendency) during the application of mechanical friction (e.g., rubbing) and the first side of the fabric exhibited pores of between 1–30 microns while the second side exhibited pores of between 10–250 microns. The air permeability of this sample was 2.1 m$^3$/m$^2$/min (the same as for regular Typar® samples), but the water tightness was between 19–20 cm water head (versus 10–12 cm on regular Typar® samples). This reflects finer pores.

Concrete was cast on the first side of the special Typar® sample and the results were similar to the ones obtained in Example 2. In brief, no filaments came loose, the fabric was easily removable from the cured concrete, and the fabric was capable of being used 2–3 additional times.

EXAMPLE 8

In this example, concrete was cast with the first side of the Typar® sheet against the form and it was compared to concrete cast with a patterned second side (i.e., a pattern-bonded side with 0.15–0.20 mm deep bond points of 1.5×2.5 mm regularly spread and covering 20% of the total area) against the form. The concrete obtained in both cases was free of blowholes, with color and surface hardness comparable to concrete obtained with Typar® as described in Example 1. Of course, the side with the concrete cast on the pattern-bonded side showed a nice pattern of concrete protrusions.

However, when a piece of concrete was broken so that a cross-section could be seen, the following was observed. The color of the concrete made using the non-patterned side of the Typar® sheet was darker near the surface than inside the block (it is known that darker concrete means a lower water/cement ratio, which provides improved concrete properties). The darker color extended 3–5 mm deeper (30–50% in this case) on the side of the concrete obtained with the pattern-bonded side placed against the form. This is probably due to different capillary behavior which allows better water wicking during the few hours between concrete casting and the start of concrete hardening. Accordingly, having a pattern of depressions or protrusions on the side against the form, improves the wicking behavior and thereby results in a significant quality improvement in the concrete.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

I claim:

1. A concrete form for making a patterned concrete surface comprising:

(a) a support means;

(b) a grid having interconnected spacing members which form holes in the grid having an individual area of at least 0.25 $cm^2$ to create the patterned concrete surface, and at least a portion of the spacing members rest against the support means;

(c) a porous, two-sided fabric juxtaposed, but not attached to, the grid and set apart from the support means by the grid, the fabric having a first fabric side having a pore size between 0.2 to 20 microns in order to prevent substantially all concrete particles from entering therein and a second side having a pore size larger than the pore size of the first side and between 10 to 250 microns; and (d) fabric stretching means to continuously stretch the porous, two-sides fabric uniformly over the grid throughout the concrete making process.

2. A concrete form for making a smooth, flat concrete surface comprising:

(a) a support with a smooth, flat surface;

(b) a porous, two-sided fabric juxtaposed with, but not attached to, the smooth surface of the support, the fabric having a first fabric side having a pore size between 0.2 to 20 microns in order to prevent substantially all concrete particles from entering therein and a second side having a pore size larger than the pore size of the first side and between 10 to 250 microns; and (c) fabric stretching means to continuously stretch the porous, two-sided fabric uniformly over the support at a uniform tension of 0.2 to 3.0 kg/lineal cm throughout the concrete making process.

3. A concrete form for making a patterned concrete surface comprising:

(a) support means having holes with an individual area of at least 0.25 $cm^2$ to create the patterned concrete surface; and (b) a porous, two-sided fabric juxtaposed with, but not attached to, the surface of the support means, the fabric having a first fabric side having a pore size between 0.2 to 20 microns in order to prevent substantially all concrete particles from entering therein and a second side having a pore size larger than the pore size of the first side and between 10 to 250 microns; and (c) fabric stretching means to continuously stretch the porous, two-sided fabric uniformly over the support means throughout the concrete making process.

4. The concrete form of claim 2 further comprising a grid between the support and the fabric, wherein the grid has interconnected spacing members which form holes in the grid having an individual area of less than 0.25 $cm^2$ and at least a portion of the spacing members rest against the support.

5. The concrete form of claims 1, 2 or 3 wherein the first side of the fabric is coated with a polymer material.

6. The concrete form of claim 5 wherein the coated first side of the fabric has a pore size of between 0.5 to 10 microns.

7. The concrete form of claims 1, 2 or 3 wherein the porous fabric is woven.

8. The concrete form of claims 1, 2 or 3 wherein the porous fabric is nonwoven.

9. The concrete form of claims 1, 2 or 3 wherein the porous fabric has a basis weight of between 70 to 600 $g/m^2$.

10. The concrete form of claim 5 wherein the coating is applied to the first side of the porous fabric in the range of 5 to 80 $g/m^2$.

11. The concrete form of claim 5 wherein the polymer material is selected from the group consisting of ethylene-vinyl chloride, ethylene-vinyl acetate and copolymers thereof.

12. The concrete form of claim 4 wherein the first side of the fabric is further coated with a natural or synthetic oil to reduce friction and adhesion between the coated fabric and the concrete during use.

13. The concrete form of claim 8 wherein the nonwoven fabric is a thermobonded polyolefin sheet material.

14. The concrete form of claim 13 wherein the polyolefin is selected from the group consisting of polyethylene and polypropylene.

15. The concrete form of claims 1, 2 or 3 wherein the fabric is smooth calendered on the first side to improve the surface stability of the fabric.

16. The concrete form of claim 8 wherein the first side of the nonwoven fabric has an extruded polymer coating thereon and perforations therethrough such that the resulting fabric has an air permeability of between 0.05 to 4 $m^3/m^2/min$.

17. The concrete form of claims 1, 2 or 3 wherein the first side of the fabric has a separate microporous spunbonded polyethylene sheet material laminated thereto.

18. The concrete form of claims 1, 2 or 3 wherein the first side of the fabric has melt blown fibers pattern-bonded thereto.

19. The concrete form of claims 1, 2 or 3 wherein the second side of the fabric has a pattern of protrusions or depressions of 0.1 to 2 mm in depth to promote water wicking during concrete hardening.

20. The concrete form of claims 1, 2 or 3 wherein the fabric comprises a non-compressible base material laminated to a microporous film, such that the film comprises the first side of the fabric.

21. The concrete form of claim 20 wherein the non-compressible base material is metal or plastic.

22. A process for making a concrete form used in making a patterned concrete surface comprising the steps of:

(a) establishing a support having the shape desired for a concrete article to be made;

(b) affixing a grid to the support wherein the grid has interconnected spacing members which form holes in the grid having an individual area of at least 0.25 $cm^2$ to create the patterned concrete surface, and at least a portion of the spacing members rest against the support;

(c) juxtaposing, but not attaching, a porous, two-sided fabric to the grid, the fabric having a first side with a pore size of between 0.2 to 20 microns in order to prevent substantially all concrete particles from entering therein and a second side with a pore size larger than the pore size of the first side and between 10 to 250 microns, the fabric set apart from the support by the grid; and (d) continuously stretching the porous fabric uniformly over the grid throughout the concrete making process.

* * * * *